US008552825B2

(12) United States Patent
Chou

(10) Patent No.: US 8,552,825 B2
(45) Date of Patent: Oct. 8, 2013

(54) IRON CORE WINDING ASSEMBLY

(75) Inventor: Tsung-Han Chou, Keelung (TW)

(73) Assignee: Innotrans Technology Co., Ltd., Taipei (TW)

( * ) Notice: Subject to any disclaimer, the term of this patent is extended or adjusted under 35 U.S.C. 154(b) by 0 days.

(21) Appl. No.: 13/525,985

(22) Filed: Jun. 18, 2012

(65) Prior Publication Data

US 2013/0141201 A1 Jun. 6, 2013

(30) Foreign Application Priority Data

Dec. 1, 2011 (TW) ..... 100222677 A

(51) Int. Cl.
*H01F 27/08* (2006.01)
*H01F 27/02* (2006.01)

(52) U.S. Cl.
USPC ..... 336/55; 336/59; 336/83

(58) Field of Classification Search
USPC ..... 336/55, 59, 60, 65, 83, 208, 221
See application file for complete search history.

(56) References Cited

U.S. PATENT DOCUMENTS 3,423,709 A * 1/1969 Lugten ..... 336/83
4,352,080 A * 9/1982 Mitsui et al. ..... 336/83
6,501,362 B1 * 12/2002 Hoffman et al. ..... 336/198
6,696,913 B2 * 2/2004 Meuche et al. ..... 336/208
7,598,837 B2 * 10/2009 Gilmartin et al. ..... 336/192
7,701,320 B2 * 4/2010 Iwakura et al. ..... 336/212
7,876,189 B2 * 1/2011 Gilmartin et al. ..... 336/192
8,054,184 B2 * 11/2011 Cline et al. ..... 340/572.1

FOREIGN PATENT DOCUMENTS

TW M290607 5/2006
TW I268520 12/2006

* cited by examiner

*Primary Examiner* — Mohamad Musleh
*Assistant Examiner* — Joselito Baisa
(74) *Attorney, Agent, or Firm* — Muncy, Geissler, Olds & Lowe, PLLC

(57) ABSTRACT

An iron core winding assembly comprises a coil rack and an iron core structure coupled with the coil rack. The coil rack includes a winding portion, a through hole located in the winding portion and at least one lateral wire exit portion extended from the winding portion. The iron core structure includes two end walls and two axial magnetic cylinders located between the two end walls, and two top walls and two bottom walls located between the two end walls to cover the winding portion. Each axial magnetic cylinder runs through the through hole. Each top wall forms a wire exit notch with the bottom wall run through by the lateral wire exit portion. The iron core winding assembly thus formed is positioned transversely on an electronic baseboard at a desired height. By separating the winding portion and electronic baseboard via the bottom wall, electromagnetic interference can be avoided.

9 Claims, 5 Drawing Sheets

IRON CORE WINDING ASSEMBLY

FIELD OF THE INVENTION

The present invention relates to an iron core winding assembly and particularly to an iron core winding assembly to mask coils.

BACKGROUND OF THE INVENTION

In electronic circuits many important functions require the technique of electromagnetic induction and conversion. The most commonly used element is the coil set. For instance, R.O.C. patent No. M290607 discloses a transformer for electronic devices. It includes a winding seat, an iron core set and a holder. The winding seat has a winding zone. The iron core set is coupled with the winding seat. The holder covers a portion of the iron core set and is located between the iron core set and an electronic device. The transformer is positioned upright on the electronic device at a selected height.

These days design of electronic products increasingly focuses on thin and light. The internal space height is limited. Hence the height of electronic element inside the products also becomes one of important factors in the design of coil sets. R.O.C. patent No. I268520 also discloses a transformer which includes a plurality of winding seats and a plurality of iron cores coupled with the winding seats. Each winding seat has a primary coil zone, a secondary coil zone and a through hole. The winding seats are coupled together to form a housing space. The transformer is designed in a transverse manner, hence greatly reduces the height needed in installation. However, when it is installed inside an electronic product, the coil zone and circuit elements of the electronic product have no mask between them, thus electromagnetic interference (EMI) easily occurs. At present, the simplest technique adopted is to wind the coil set by an insulation tape to reduce the EMI between the coil set and electronic product. But such an approach provides limited barrier effect. Moreover, the insulation tape is relatively fragile and easily damaged during transportation and assembly process. Hence EMI still cannot be fully avoided as desired.

Therefore, an iron core set and a coil rack with desired height and improved electromagnetic characteristics without generating EMI are needed to meet requirements of thin and light products in the current trend.

SUMMARY OF THE INVENTION

The primary object of the present invention is to solve the EMI problem that is easily generated between a transformer of a lower height and electronic products in the conventional techniques.

To achieve the foregoing object, the present invention provides an iron core winding assembly which comprises a coil rack and an iron core structure coupled with the coil rack. The coil rack is wound by a wire and includes a winding portion, a through hole located in the winding portion and at least one lateral wire exit portion extended from one side of the winding portion. The iron core structure includes two end walls and two axial magnetic cylinders located between the two end walls, and two top walls and two bottom walls located between the two end walls to cover the winding portion. The two axial magnetic cylinders run through the through hole of the coil rack. Each top wall has a cooling vent and forms a wire exit notch with the bottom wall run through by the lateral wire exit portion.

In one aspect the wire exit notch is formed at a width greater than that of the cooling vent.

In another aspect the lateral wire exit portion includes a wire exit opening threaded through by the wire.

In yet another aspect the lateral wire exit portion includes a holding zone to hold the iron core structure and a threading slot communicating with the holding zone and run through by the bottom wall.

In yet another aspect the holding zone includes a support portion corresponding to the bottom wall to confine the bottom wall from moving in the holding zone.

In yet another aspect the iron core structure is divided into a first iron core and a second iron core. The first iron core and second iron core have respectively the top wall and bottom wall, and are coupled with the coil rack via the through hole.

In yet another aspect the iron core structure has two sides which have respectively a first mask section connected to the top wall and a second mask section connected to the bottom wall. The first and second mask sections form the wire exit notch between them.

In yet another aspect the first mask section has two ends spaced from each other at a distance greater than that between two ends of the second mask section.

In yet another aspect the first mask section and top wall are connected to form an arched shape.

In yet another aspect the end wall has two recesses at two sides communicating with the wire exit notch. The recess is gradually shrunk from the first mask section and second mask section towards the center of the recess. The cooling vent is gradually shrunk from the top wall towards the bottom wall.

By means of the structure set forth above the invention can provide many advantages, notably:

The coil rack is transversely positioned on an electronic baseboard at a desired height. By separating the winding portion and electronic baseboard, EMI can be avoided.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
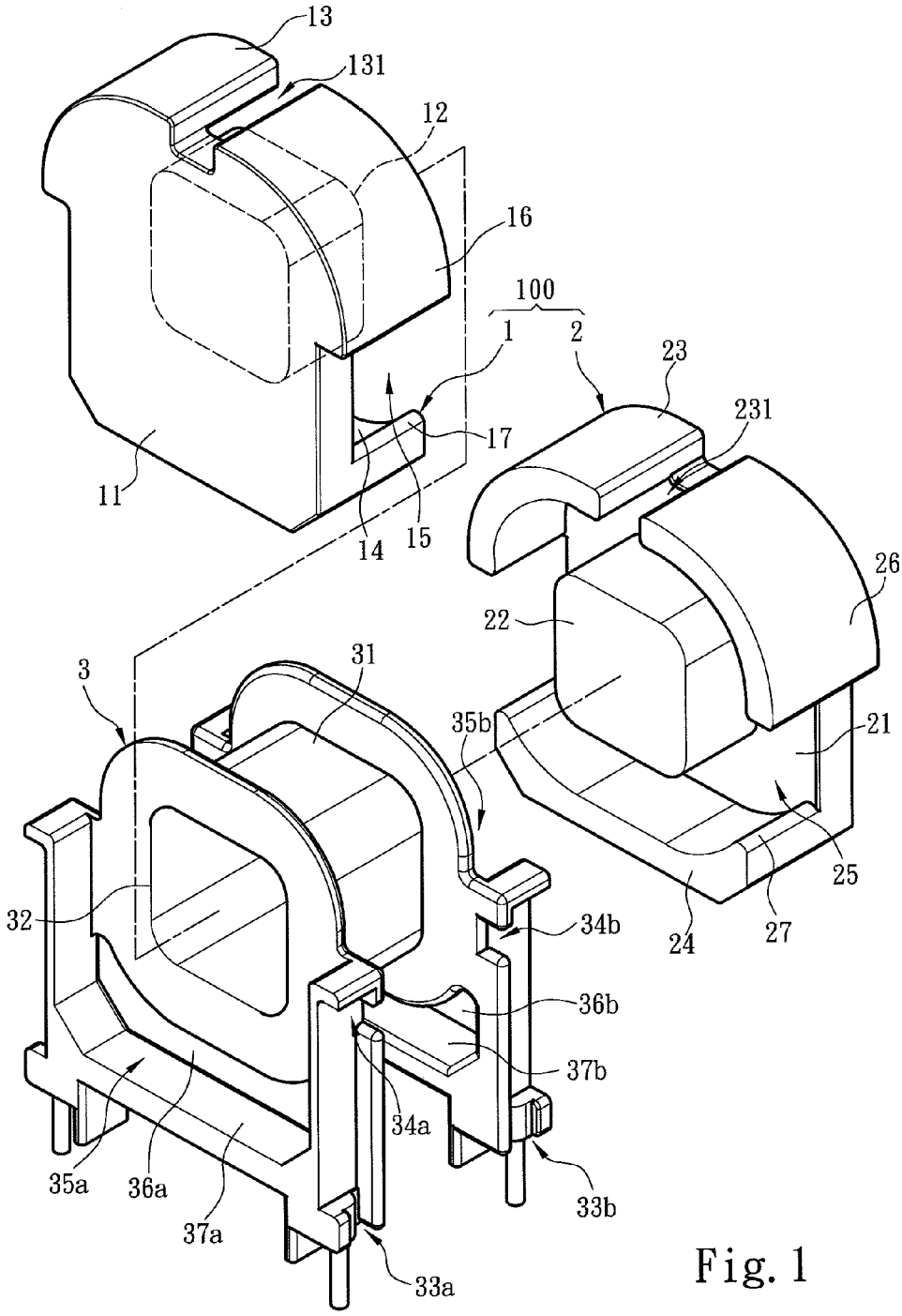
FIG. 1 is an exploded view of the iron core winding assembly of the invention.
Figure 2:
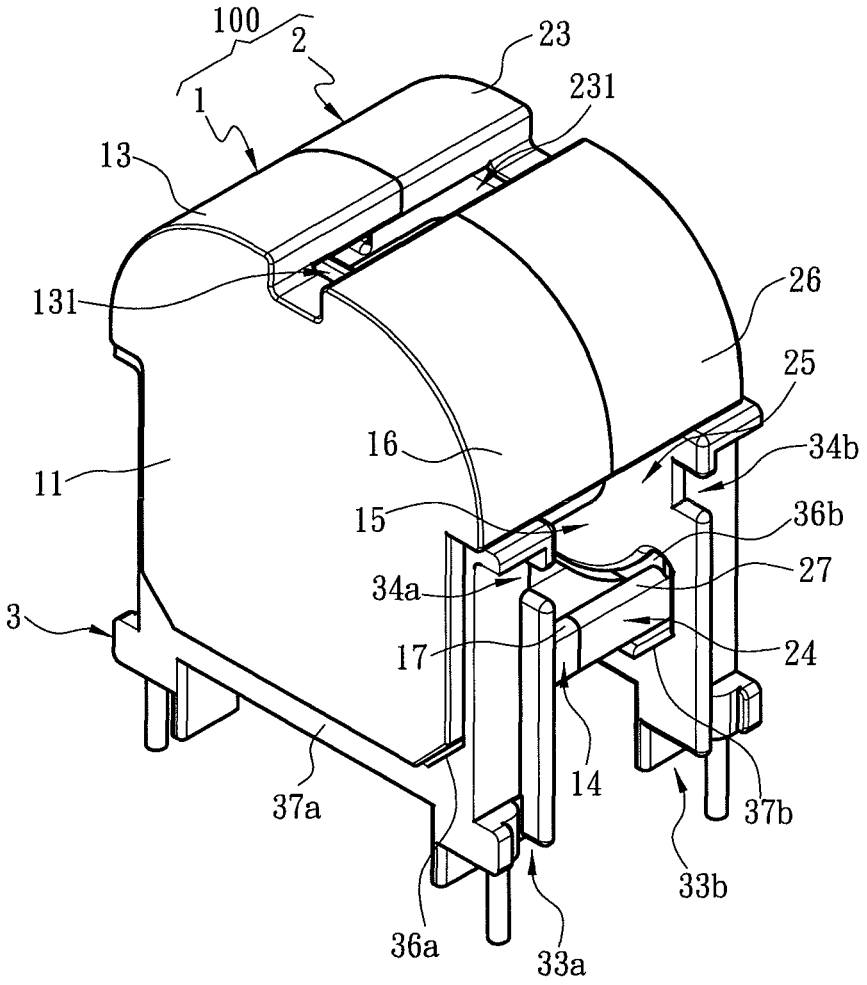
FIG. 2 is a perspective view of the iron core winding assembly of the invention.

Please referring to FIGS. 1 and 2, the present invention aims to provide an iron core winding assembly which includes a coil rack 3 and an iron core structure 100 coupled with the coil rack 3. The coil rack 3 is wound by a wire 4 (referring to FIG. 3) and includes a winding portion 31, a through hole 32 in the winding portion 31 and at least one lateral wire exit portion 33*a* and 33*b* extended from one side of the winding portion 31. The iron core structure 100 includes two end walls 11 and 21 and two axial magnetic cylinders 12 and 22 located between the two end walls 11 and 21, and two top walls 13 and 23 and two bottom walls 14 and 24 located between the two end walls 11 and 21 to cover the winding portion 31. The axial magnetic cylinders 12 and 22 run through the through hole 32 of the coil rack 3. The top walls 13 and 23 have respectively a cooling vent 131 and 231. The top walls 13 and 23 and bottom walls 14 and 24 respectively form wire exit notches 15 and 25 between them run through by the lateral wire exit portions 33*a* and 33*b*. In an embodiment, the lateral wire exit portions 33*a* and 33*b* further have respectively wire exit openings 34*a* and 34*b* run through by the wire 4, holding zones 35*a* and 35*b* to hold the iron core structure 100 and threading slots 36*a* and 36*b* communicating with the holding zones 35*a* and 35*b* and run through by the bottom walls 14 and 24. The holding zones 35*a* and 35*b* have respectively support portions 37*a* and 37*b* corresponding to the bottom walls 14 and 24 to confine the bottom walls 14 and 24 from moving in the holding zones 35*a* and 35*b*. The iron core structure 100 further has two sides each having a first mask section 16 or 26 connecting to the top wall 13 or 23 and a second mask section 17 or 27 connecting to the bottom wall 14 or 24. The first mask sections 16 and 26 and second mask sections 17 and 27 jointly form the wire exit notches 15 and 25. The first mask sections 16 and 26 are connected to the top walls 13 and 23 to respectively form an arched shape. The first mask section 16 or 26 has two ends spaced from each other at a distance greater than that between two ends of the second mask section 17 or 27. In addition, the iron core structure 100 includes a first iron core 1 and a second iron core 2 mating each other. The first iron core 1 includes the end wall 11, axial magnetic cylinder 12, top wall 13 and bottom wall 14. The top wall 13 has the cooling vent 131. The second iron core 2 includes the end wall 21, axial magnetic cylinder 22, top wall 23 and bottom wall 24. The top wall 23 also has the cooling vent 231. The first and second iron cores 1 and 2 are coupled with the coil rack 3 via the through hole 32. The first and second iron cores 1 and 2 are respectively positioned in the two holding zones 35*a* and 35*b* with the axial magnetic cylinders 12 and 22 running through the through hole 32 to connect to each other. The top walls 13 and 23 also are connected to each other. The bottom walls 14 and 24 run through respectively the threading slots 36*a* and 36*b* to connect to each other, and are confined by the support portions 37*a* and 37*b* without moving in the holding zones 35*a* and 35*b*, thereby the first and second iron cores 1 and 2 also are confined without sliding. In this embodiment, the axial magnetic cylinders 12 and 22 running through the through hole 32 are formed respectively on the first and second iron cores 1 and 2 to connect to each other. The axial magnetic cylinders 12 and 22 also can be integrally formed on the first iron core 1 or second iron core 2. Any variations of the axial magnetic cylinders 12 and 22 in terms of the length and location that can be made by those skilled in the art shall be included in the scope of claims of the invention. The top wall 13 and bottom wall 14 of the first iron core 1 are extended from the end wall 11 towards the second iron core 2. Similarly, the top wall 23 and bottom wall 24 of the second iron core 2 are extended from the end wall 21 towards the first iron core 1 such that the two top walls 13 and 23 are connected to each other and the two bottom walls 14 and 24 also are connected to each other to cover the winding portion 31. In this embodiment, the first iron core 1 has the first mask section 16 on each of two sides connecting to the top wall 13 and the second mask section 17 connecting to the bottom wall 14. The first and second mask sections 16 and 17 form the wire exit notch 15 between them. Similarly, the second iron core 2 has the first mask section 26 on each of two sides connecting to the top wall 23 and the second mask section 27 connecting to the bottom wall 24. The first and second mask sections 26 and 27 form the wire exit notch 25 between them. The wire exit notches 15 and 25 are formed at a width greater than that of the cooling vents 131 and 231 on the top walls 13 and 23. Any variations of the cooling vents 131 and 231 in terms of size and location that can be made by those skilled in the art also shall be included in the scope of claims of the invention.

Figure 3:
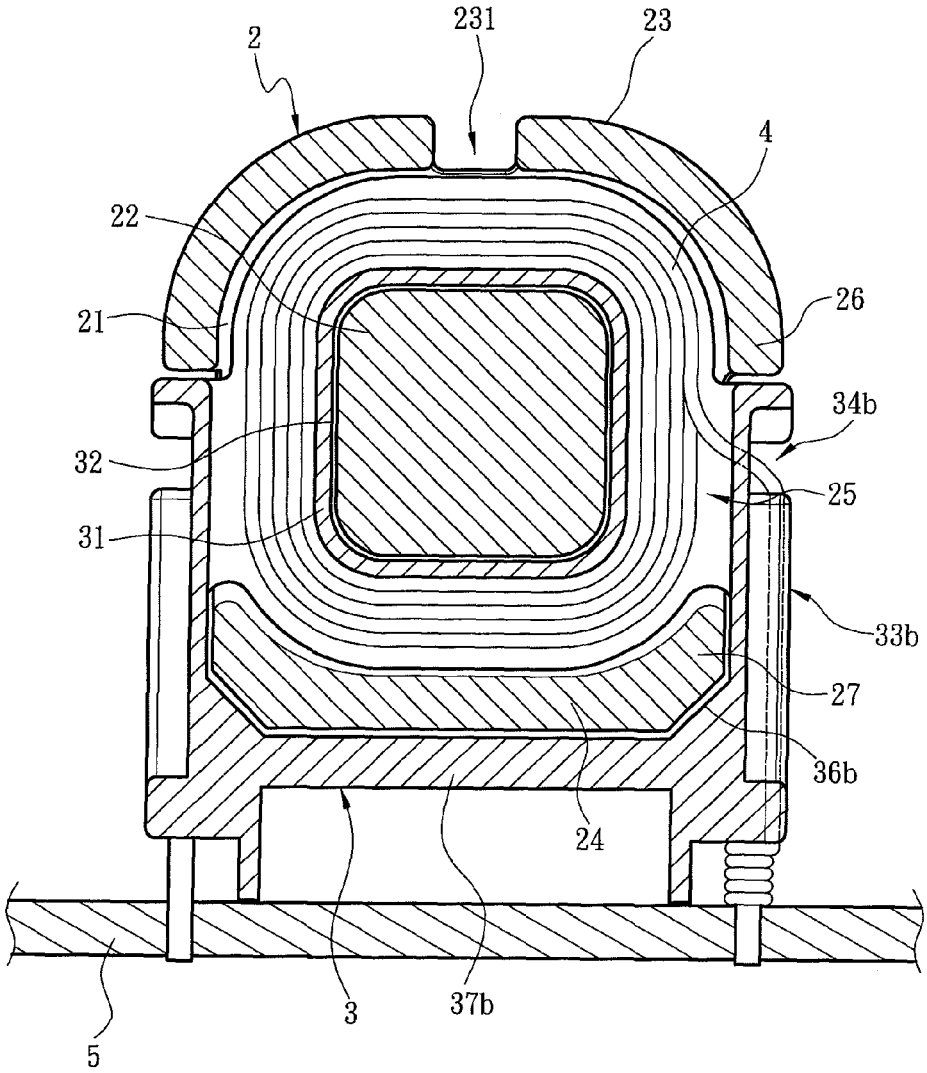
FIG. 3 is a cross section of the iron core winding assembly of the invention in a use condition.
Figure 4:
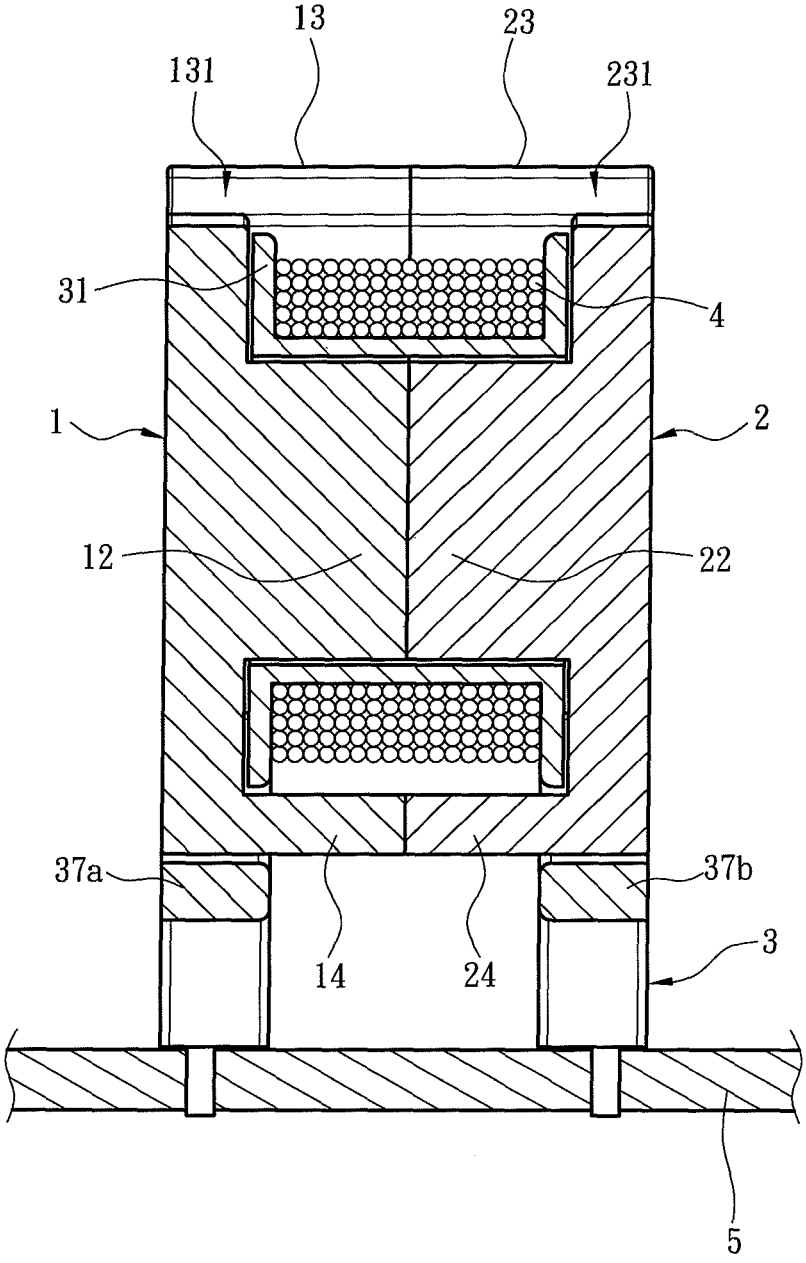
FIG. 4 is another cross section of the iron core winding assembly of the invention in a use condition.

Please refer to FIGS. 1, 3 and 4 for an embodiment of the invention in use. The coil rack 3 has the lateral wire exit portions 33*a* and 33*b* at the openings of two ends of the through hole 32 to allow one end of the wire 4 to thread in via one lateral wire exit portion 33*b* and wire exit opening 34*b* and wind on the winding portion 31; after the winding is finished, the wire 4 is threaded out via another exit opening 34*a* (not shown in the drawings) at another end of the lateral wire exit portion 33*a*. Any variations of wiring out and in of the wire 4 in terms of location or sequence that can be made by those skilled in the art also shall be included in the scope of claims of the invention. After the coil rack 3 wound by the wire 4 is coupled with the first and second iron cores 1 and 2, the axial magnetic cylinders 12 and 22 run through the through hole 32 and connect to each other, the top walls 13 and 23 are connected to each other, and the bottom walls 14 and 24 run through the threading slots 36*a* and 36*b* to also connect to each other, thereby a magnetic loop is formed. In this embodiment, the assembled coil rack 3 and iron core structure 100 can be installed on an electronic baseboard 5 of an electronic product with the axis of the through hole 32 parallel with the electronic baseboard 5, i.e. installed transversely, hence the height can be reduced. When the electronic product is in operation, EMI can be averted due to the bottom walls 14 and 24 separating the winding portion 31 and electronic baseboard 5, thus improved electromagnetic characteristics is improved.

Figure 5:
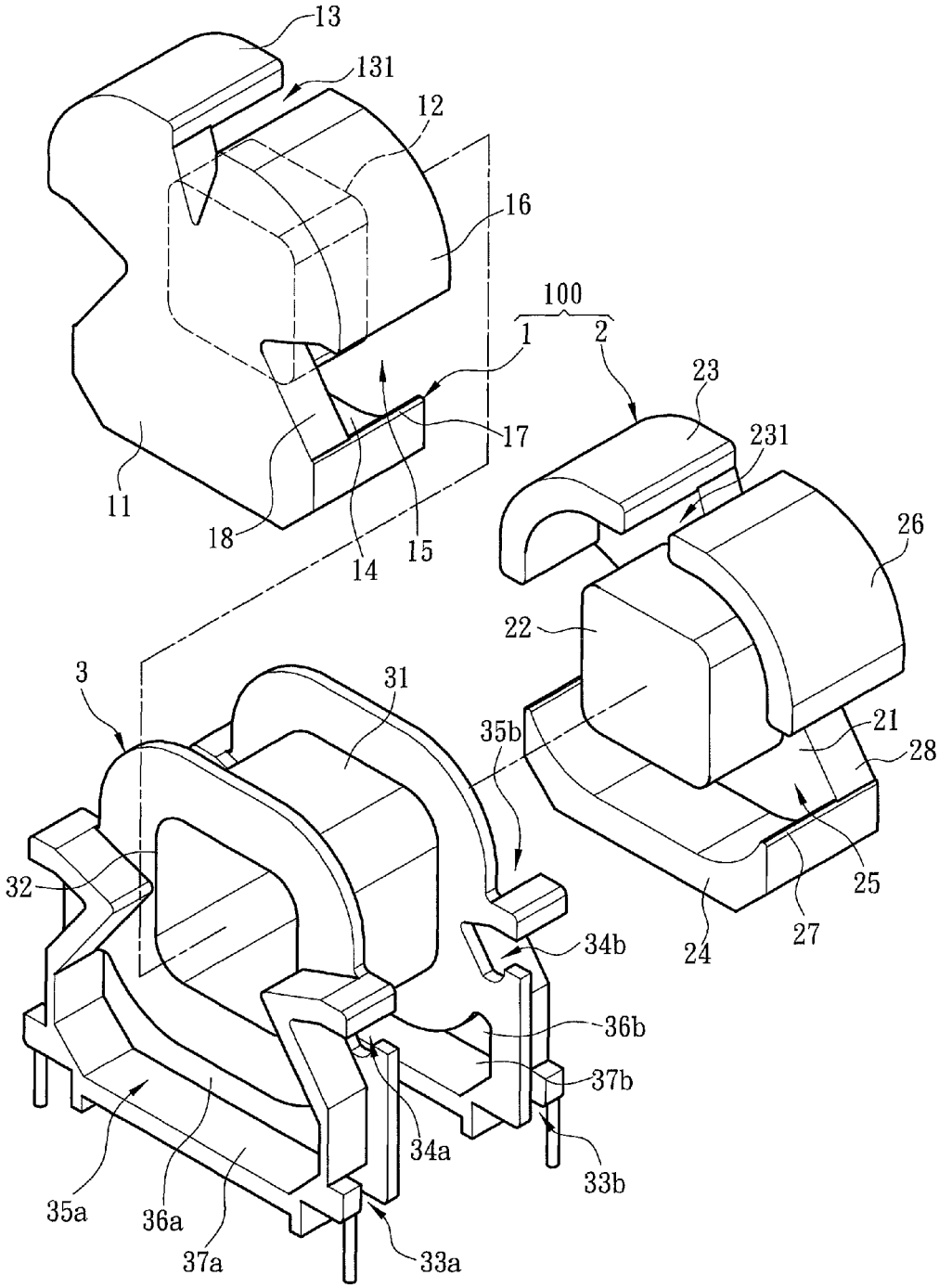
FIG. 5 is an exploded view of another embodiment of the iron core winding assembly of the invention.

The construction of the iron core structure 100 and coil rack 3, aside from the embodiment previously discussed, as shown in FIG. 5, the end walls 11 and 21 have respectively two recesses 18 and 28 at two sides communicating with the wire exit notches 15 and 25. The recesses 18 and 28 are gradually shrunk from the first mask sections 16 and 26 and the second mask sections 17 and 27 towards the center of the recesses 18 and 28. The cooling vents 131 and 231 are also gradually shrunk from the top walls 13 and 23 towards the bottom walls 14 and 24. The coil rack 3 has a mating structure to hold the iron core structure 100. The iron core structure 100 thus formed can save material and reduce costs. It also provides improved design and aesthetic appeal.

In short, the iron core structure 100 and coil rack 3 of the invention are positioned transversely on an electronic baseboard 5 at a desired height, hence can facilitate production of thinner and lighter electronic products. By separating the winding portion 31 and electronic baseboard 5 via the bottom walls 14 and 24, EMI can be avoided. Through the first mask sections 16 and 26, and second mask sections 17 and 27, a greater covering area can be provided for the winding portion 31 to offer improved electromagnetic characteristics. As a result, the iron core structure 100 of the invention can resolve the problem of EMI caused by the transformer with a lower height in the electronic product.

While the preferred embodiments of the invention have been set forth for the purpose of disclosure, they are not the limitations of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An iron core winding assembly, comprising:

a coil rack including a winding portion wound by a wire, a through hole located in the coil rack and at least one lateral wire exit portion extended from one side of the winding portion; and an iron core structure which is coupled with the coil rack and includes two end walls and two axial magnetic cylinders located between the two end walls, and two top walls and two bottom walls between the two end walls to cover the winding portion, the two axial magnetic cylinders running through the through hole of the coil rack, each of the two top walls including a cooling vent and forming a wire exit notch with one of the two bottom walls run through by the at least one lateral wire exit portion, wherein the iron core structure includes two first mask sections each connecting to the top wall and two second mask sections each connecting to the bottom wall, the first mask section and the second mask section forming the wire exit notch between them.

2. The iron core winding assembly of claim 1, wherein the wire exit notch is formed at a width greater than that of the cooling vent.

3. The iron core winding assembly of claim 1, wherein the lateral wire exit portion includes a wire exit opening threaded through by the wire.

4. The iron core winding assembly of claim 1, wherein the lateral wire exit portion includes a holding zone to hold the iron core structure and a threading slot communicating with the holding zone and run through by one of the two bottom walls.

5. The iron core winding assembly of claim 4, wherein the holding zone includes a support portion corresponding to the bottom wall to confine the bottom wall from moving in the holding zone.

6. The iron core winding assembly of claim 1, wherein the iron core structure includes a first iron core and a second iron core that include respectively the top wall and the bottom wall, the first iron core and the second iron core being coupled with the coil rack via the through hole.

7. The iron core winding assembly of claim 1, wherein the first mask section includes two ends spaced from each other at a distance greater than that between two ends of the second mask section.

8. The iron core winding assembly of claim 1, wherein the first mask section and the top wall are connected to form an arched shape.

9. The iron core winding assembly of claim 1, wherein each of the two end walls includes two recesses at two sides thereof communicating with the wire exit notch, each of the two recesses being gradually shrunk from the first mask section and the second mask section towards a center of the recess, the cooling vent being shrunk gradually from the top wall towards the bottom wall.

* * * * *